US010008153B2

(12) United States Patent
Hu

(10) Patent No.: US 10,008,153 B2
(45) Date of Patent: Jun. 26, 2018

(54) PIXEL CIRCUIT AND DRIVING METHOD THEREOF, ARRAY SUBSTRATE, DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventor: Zuquan Hu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 0 days. days.

(21) Appl. No.: 15/123,426

(22) PCT Filed: Jan. 5, 2016

(86) PCT No.: PCT/CN2016/070105
§ 371 (c)(1),
(2) Date: Sep. 2, 2016

(87) PCT Pub. No.: WO2017/024754
PCT Pub. Date: Feb. 16, 2017

(65) Prior Publication Data

US 2017/0178569 A1 Jun. 22, 2017

(30) Foreign Application Priority Data

Aug. 13, 2015 (CN) ..... 2015 1 0497655

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC ..... G09G 3/3258; G09G 3/3233; G09G 2300/0819; G09G 2310/0251; G09G 2320/0233; G09G 2320/045
(Continued)

(56) References Cited

U.S. PATENT DOCUMENTS

2006/0139252 A1 6/2006 Lee
2008/0054798 A1 3/2008 Jeong et al.

FOREIGN PATENT DOCUMENTS

CN 101256732 A 9/2008
CN 102346999 A 2/2012
(Continued)

OTHER PUBLICATIONS

First Office Action dated Jan. 18, 2017 in corresponding Chinese Application No. 201510497655.9.
(Continued)

*Primary Examiner* — Michael Pervan
(74) *Attorney, Agent, or Firm* — Nath, Goldberg & Meyer; Joshua B. Goldberg

(57) ABSTRACT

The present invention provides a pixel circuit and a driving method thereof, an array substrate and a display device. The pixel circuit includes: an operation unit, a storage module, a driving module, a compensation module and a control module; in an initialization phase, the compensation module and the driving module are initialized under the control of the first power supply; in a data writing and charging phase, the data signal input terminal charges the storage module via the compensation module and the driving module, such that a threshold voltage corresponding to the driving module is
(Continued)

inputted into a voltage difference across two terminals of the storage module; and in an operation phase, the control module is switched on, and the storage module discharges to the operation unit via the driving module to allow the operation unit to emit light.

12 Claims, 3 Drawing Sheets

(51) Int. Cl.
*G09G 3/3266* (2016.01)
*G09G 3/3275* (2016.01)

(52) U.S. Cl.
CPC ... *G09G 3/3275* (2013.01); *G09G 2300/0819* (2013.01); *G09G 2310/0251* (2013.01); *G09G 2320/0233* (2013.01); *G09G 2320/045* (2013.01)

(58) Field of Classification Search
USPC ..... 345/76–83, 690–697
See application file for complete search history.

(56) References Cited

FOREIGN PATENT DOCUMENTS

| | | | |
|---|---|---|---|
| CN | 103456263 | A | 12/2013 |
| CN | 103886826 | A | 6/2014 |
| CN | 104282259 | A | 1/2015 |
| CN | 105096826 | A | 11/2015 |

OTHER PUBLICATIONS

International Search Report dated Apr. 28, 2016 issued in corresponding International Application No. PCT/CN2016/070105 along with an English translation of the Written Opinion of the International Searching Authority.

PIXEL CIRCUIT AND DRIVING METHOD THEREOF, ARRAY SUBSTRATE, DISPLAY DEVICE

This is a National Phase Application filed under 35 U.S.C. 371 as a national stage of PCT/CN2016/070105, filed Jan. 5, 2016, an application claiming the benefit of Chinese Application No. 201510497655.9, filed Aug. 13, 2015, the content of each of which is hereby incorporated by reference in its entirety.

TECHNICAL FIELD

The present invention relates to the field of display technology, and particularly relates to a pixel circuit and a driving method thereof, an array substrate including the pixel circuit and a display device including the array substrate.

BACKGROUND

As the display technology advances, more and more active matrix organic light emitting diode (AMOLED) display panels enter the market. Compared to a conventional thin film transistor liquid crystal display (TFT LCD) panel, an AMOLED display panel has a faster response speed, a higher contrast, and a wider viewing angle. Therefore, AMOLED display panels gain more and more attention of panel manufactures.

FIG. 1 is a circuit diagram of a pixel circuit in an existing AMOLED display panel. It can be seen from FIG. 1 that, the circuit diagram includes a thin film transistor $T_D$, a thin film transistor $T_S$, a storage capacitor C and an OLED. The thin film transistor $T_S$ has a gate connected to a scan signal line Vscan, a drain connected to a data signal input terminal Vdata, and a source connected to a gate of the thin film transistor $T_D$. The thin film transistor $T_D$ has a drain connected to a cathode of the OLED, and a source connected to a second power supply ELVss, and the second power supply ELVss is at a low level. Two terminals of the storage capacitor C are connected across the gate and the source of the thin film transistor $T_D$. An anode of the OLED is connected to a third power supply ELVdd, and the third power supply ELVdd is at a high level. The thin film transistor $T_D$ and the thin film transistor $T_S$ may each be an N type thin film transistor.

FIG. 2 is a timing diagram for driving the pixel circuit in FIG. 1. It can be seen from FIGS. 1 and 2 that, in time period t1, the scan signal line Vscan is at a high level, and thus the thin film transistor $T_S$ is turned on. At this time, a high level at the data signal input terminal Vdata is written into the storage capacitor C and the gate of the thin film transistor $T_D$, thus the thin film transistor $T_D$ is turned on, at this point, the cathode of the OLED is connected to the second power supply ELVss, and the OLED starts to operate and emit light. In time period t2, the scan signal line Vscan is at a low level, and thus the thin film transistor $T_S$ is turned off. At this time, due to the discharge retention effect of the storage capacitor C, the gate of the thin film transistor $T_D$ remains at high-level state, thus the thin film transistor $T_D$ is still on, the OLED continues operating, and the light-emitting state of the OLED may not change until a subsequent time point when a high-level signal of the scan signal line Vscan arrives. It can be seen from the above that, the thin film transistor $T_S$ controls the writing of a voltage of the data signal input terminal Vdata, and thus is generally referred to as switch transistor, and the thin film transistor $T_D$ controls operating state of the OLED, and thus is generally referred to as driving transistor. In addition, the storage capacitor C mainly plays a role of maintaining voltage.

However, at least the following problems exist in the prior art. The threshold voltage Vth of the driving transistor $T_D$ may drift as display time of the panel increases, and luminance of the OLED is closely related to the threshold voltage Vth of the driving transistor $T_D$, so a change in the threshold voltage Vth of the driving transistor $T_D$ will have a great impact on the luminance of the OLED, and specifically, the change in the threshold voltage Vth of the driving transistor $T_D$ affects luminance uniformity of the OLED. In addition, in a light emission holding phase of the AMOLED display panel, electric leakage of the switch transistor $T_S$ will also result in a change in the driving voltage of the gate of the driving transistor $T_D$, and thus lead to uneven light emission of the AMOLED display panel.

SUMMARY

In view of at least one of the problems that luminance uniformity of OLED is affected by the change in threshold voltage of a driving transistor and electric leakage of a switch transistor results in a change in driving voltage of the gate of the driving transistor $T_D$ and thus leads to uneven light emission of AMOLED display panel in the prior art, the present invention provides a pixel circuit and a driving method thereof, an array substrate including the pixel circuit, and a display device including the array substrate.

A technical solution adopted to solve the technical problem of the present invention is a pixel circuit, comprising: an operation unit, a storage module, a driving module, a compensation module and a control module, wherein, the driving module is connected to the control module, the compensation module and the storage module, the control module is also connected to the operation unit, the compensation module, the storage module and a signal input terminal, the compensation module is also connected to the storage module, a first power supply and a data signal input terminal, the storage module is also connected to the signal input terminal, and the operation unit is also connected to a third power supply; in an initialization phase, the compensation module and the driving module are initialized under the control of the first power supply; in a data writing and charging phase, the data signal input terminal charges the storage module via the compensation module and the driving module, such that a threshold voltage corresponding to the driving module is inputted into a voltage difference across two terminals of the storage module; and in an operation phase, the control module is switched on, and the storage module discharges to the operation unit via the driving module so as to allow the operation unit to operate and compensate for influence of drift of the threshold voltage corresponding to the driving module on performance of the operation unit.

Preferably, the storage module comprises a storage capacitor, one terminal of the storage capacitor is connected to the signal input terminal and the control module via a first node, and the other terminal of the storage capacitor is connected to the driving module and the compensation module via a second node.

Preferably, the driving module comprises a first switch transistor; and the first switch transistor has a gate connected to the compensation module and the storage module via a second node, a source connected to the control module and the compensation module via a fourth node, and a drain connected to the compensation module and the control module via a third node.

Preferably, the compensation module comprises: a second switch transistor, a fifth switch transistor, a sixth switch transistor, a first scan line and a third scan line; the second switch transistor has a gate connected to the first scan line, a drain connected to the data signal input terminal, and a source connected to the driving module and the control module via a third node; the fifth switch transistor has a gate connected to the first scan line, a source connected to the driving module and the control module via a fourth node, and a drain connected to the driving module and the storage module via a second node; and the sixth switch transistor has a gate connected to the third scan line, a source connected to the storage module and the driving module via the second node, and a drain connected to the first power supply.

Preferably, the control module comprises a third switch transistor, a fourth switch transistor and a second scan line; the third switch transistor has a gate connected to the second scan line, a source connected to the storage module and the signal input terminal via a first node, and a drain connected to the driving module and the compensation module via a fourth node; and the fourth switch transistor has a gate connected to the second scan line, a drain connected to the operation unit, and a source connected to the compensation module and the driving module via a third node.

Preferably, the operation unit comprises an OLED.

Preferably, sizes of the fifth switch transistor and the sixth switch transistor are the same.

Preferably, a voltage of the first power supply is ELVd=2(Vdata+Vth)−ELVss, where Vdata is a voltage of the data signal input terminal, Vth is the threshold voltage corresponding to the driving module, and ELVss is a voltage of the signal input terminal.

As another technical solution, the present invention further provides a driving method of a pixel circuit, wherein, the pixel circuit comprises: an operation unit, a storage module, a driving module, a compensation module and a control module, the driving module is connected to the control module, the compensation module and the storage module, the control module is also connected to the operation unit, the compensation module, the storage module and a signal input terminal, the compensation module is also connected to the storage module, a first power supply and a data signal input terminal, the storage module is also connected to the signal input terminal, and the operation unit is also connected to a third power supply; the driving method comprises: in an initialization phase, initializing the compensation module and the driving module under the control of the first power supply; in a data writing and charging phase, charging, by the data signal input terminal, the storage module via the compensation module and the driving module, such that a threshold voltage corresponding to the driving module is inputted into a voltage difference across two terminals of the storage module; and in an operation phase, switching on the control module, and discharging the storage module to the operation unit via the driving module so as to allow the operation unit to operate and compensate for influence of drift of the threshold voltage corresponding to the driving module on performance of the operation unit.

Preferably, the driving module comprises a first switch transistor, the compensation module comprises a sixth switch transistor and a third scan line; and the step of initializing the compensation module and the driving module under the control of the first power supply comprises: turning on the sixth switch transistor under the control of a third scan signal outputted by the third scan line; and outputting, by the first power supply, a voltage of the first power supply to the first switch transistor via the turned-on sixth switch transistor, so as to turn on the first switch transistor.

Preferably, the voltage of the first power supply is ELVd=2(Vdata+Vth)−ELVss, where Vdata is a voltage of the data signal input terminal, Vth is a threshold voltage of the first switch transistor, and ELVss is a voltage of the signal input terminal.

Preferably, the compensation module comprises a first scan line, a second switch transistor and a fifth switch transistor, the driving module comprises a first switch transistor; and the step of charging, by the data signal input terminal, the storage module via the compensation module and the driving module such that a threshold voltage corresponding to the driving module is inputted into a voltage difference across two terminals of the storage module comprises: turning on the second switch transistor and the fifth switch transistor under the control of a first scan signal outputted by the first scan line; outputting, by the data signal input terminal, a voltage of the data signal input terminal to the first switch transistor via the turned-on second switch transistor and fifth switch transistor; and charging, by the first switch transistor, the storage capacitor such that a threshold voltage of the first switch transistor is inputted into the voltage difference across the two terminals of the storage module.

Preferably, the control module comprises a second scan line, a third switch transistor and a fourth switch transistor, the driving module comprises a first switch transistor; and the step of switching on the control module and discharging the storage module to the operation unit via the driving module comprises: turning on the third switch transistor and the fourth switch transistor under the control of a second scan signal outputted by the second scan line; and discharging the storage capacitor to the operation unit via the turned-on first switch transistor, third switch transistor and fourth switch transistor, so as to allow the operation unit to operate.

As still another technical solution, the present invention provides an array substrate, comprising any one of the above pixel circuits.

As still another technical solution, the present invention provides a display device, comprising the above array substrate.

The pixel circuit of the present invention includes the operation unit, the storage module, the driving module, the compensation module and the control module, and in this pixel circuit, drift of the threshold voltage of the driving module, which occurs as the display time of the panel increases, can be compensated, and thus non-uniformity of the threshold voltage of the driving module can be compensated effectively, so that the luminance of AMOLED display panel is irrelevant to the threshold voltage of the driving module; in the meanwhile, by compensating for the change in the gate voltage of the driving module caused by leakage current of the switch transistor, and overall, luminous uniformity and display quality of the AMOLED display panel are improved, so that image uniformity of an organic light emitting display is enhanced.

DETAILED DESCRIPTION

To enable those skilled in the art to better understand the technical solutions of the present invention, the present invention will be further described in detail below in conjunction with the accompanying drawings and the specific implementations.

Embodiment 1

Figure 1:
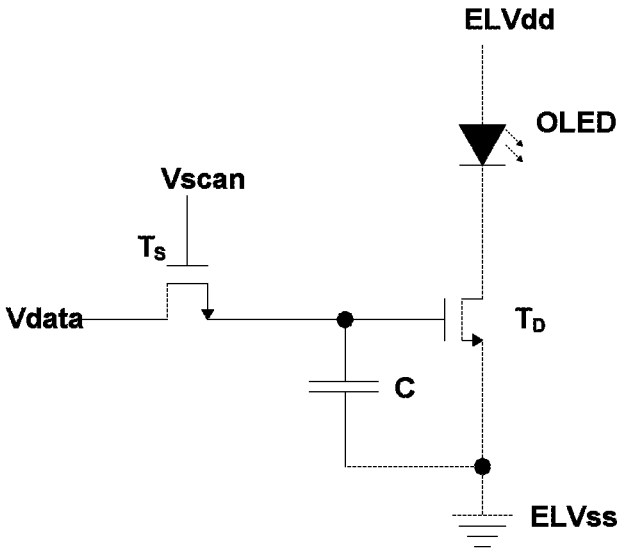
Fig. 1 (Prior Art)
FIG. 1 is a circuit diagram of an existing pixel circuit.
Figure 2:
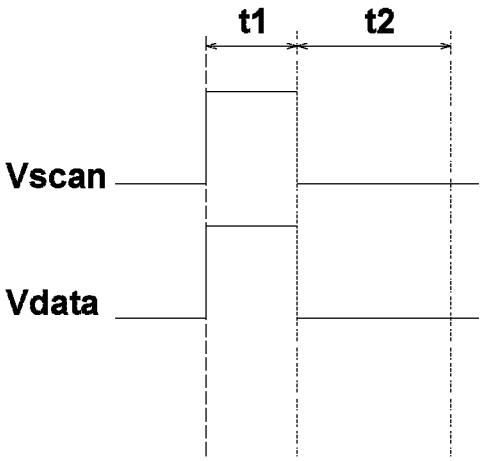
Fig. 2 (Prior Art)
FIG. 2 is a timing diagram of the pixel circuit in FIG. 1.
Figure 3:
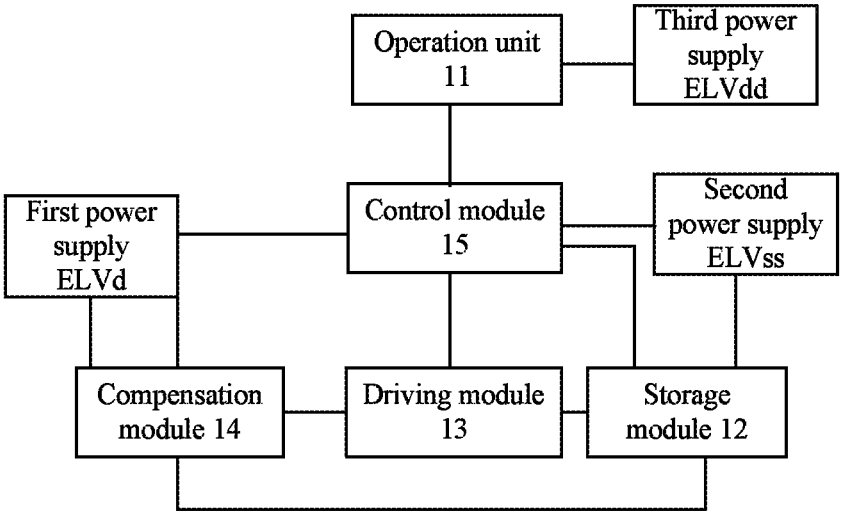
FIG. 3 is a block diagram of a pixel circuit provided by Embodiment 1 of the present invention.

FIG. 3 is a block diagram of a pixel circuit provided by this embodiment. As shown in FIG. 3, this embodiment provides a pixel circuit including an operation unit 11, a storage module 12, a driving module 13, a compensation module 14 and a control module 15. The driving module 13 is connected to the control module 15, the compensation module 14 and the storage module 12. The control module 15 is connected to the operation unit 11, the compensation module 14, the driving module 13, the storage module 12 and a signal input terminal ELVss (shown as second power supply in the figure). The compensation module 14 is connected to the control module 15, the driving module 13, the storage module 12 and a first power supply ELVd. The storage module 12 is connected to the compensation module 14, the driving module 13, the control module 15 and the signal input terminal ELVss. The operation unit 11 is connected to the control module 15 and a third power supply ELVdd.

The operating process of the pixel circuit in this embodiment may be divided into three phases: an initialization phase, a data writing and charging phase and an operation phase.

In the initialization phase, the compensation module 14 and the driving module 13 are initialized under the control of the first power supply ELVd.

In the data writing and charging phase, the data signal input terminal charges the storage module 12 via the compensation module 14 and the driving module 13, such that a threshold voltage corresponding to the driving module 13 is inputted into a voltage difference across the two terminals of the storage module 12.

In the operation phase, the control module 15 is switched on, and the storage module 12 discharges to the operation unit 11 via the driving module 13 so as to cause the operation unit 11 to operate and compensate for the influence of drift of the threshold voltage corresponding to the driving module 13 on performance of the operation unit 11.

The pixel circuit in the embodiment of the present invention includes the operation unit 11, the storage module 12, the driving module 13, the compensation module 14 and the control module 15, and in this pixel circuit, drift of the threshold voltage of the driving module 13, which occurs as the display time of the panel increases, can be compensated, and thus non-uniformity of the threshold voltage of the driving module 13 can be compensated effectively, so that the luminance of an AMOLED display panel is irrelevant to the threshold voltage of the driving module 13.

Embodiment 2

Figure 4:
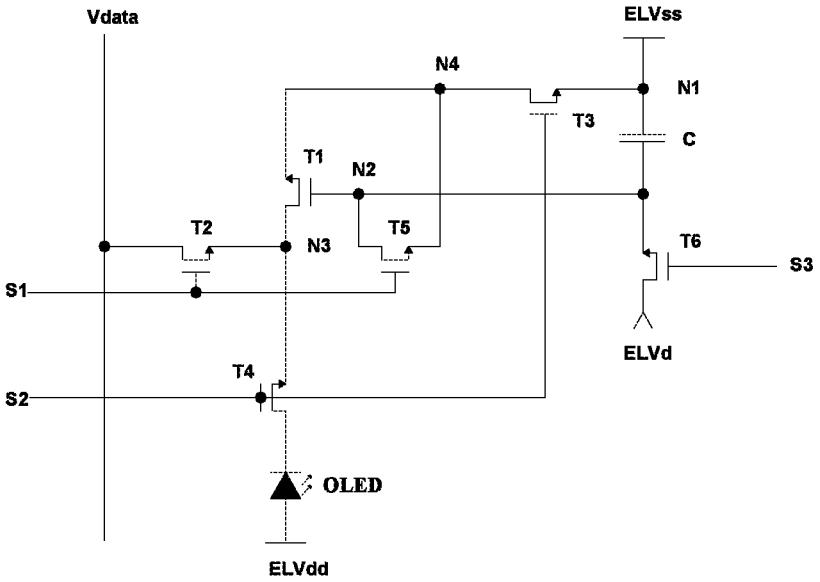
FIG. 4 is a circuit diagram of a pixel circuit provided by Embodiment 2 of the present invention.

FIG. 4 is a circuit diagram of a pixel circuit according to this embodiment. As shown in FIG. 4, this embodiment provides a specific circuit configuration for the pixel circuit in FIG. 3.

In this embodiment, referring to FIG. 4, the storage module 12 may include a storage capacitor C; the driving module 13 may include a first switch transistor T1; the compensation module 14 may include a second switch transistor T2, a fifth switch transistor T5, a sixth switch transistor T6, a first scan line S1 and a third scan line S3; the control module 15 may include a third switch transistor T3, a fourth switch transistor T4 and a second scan line S2; the operation unit 11 may include an OLED.

Referring to FIG. 4, the control module 15 is connected to the storage module 12 and the signal input terminal ELVss via a first node N1, the driving module 13 is connected to the compensation module 14 and the storage module 12 via a second node N2, the driving module 13 is connected to the compensation module 14 and the control module 15 via a third node N3, and the control module 15 is connected to the driving module 13 and the compensation module 14 via a fourth node N4.

The first switch transistor T1 has a gate connected to the second node N2, a source connected to a drain of the third switch transistor T3, and a drain connected to the third node N3; the second switch transistor T2 has a gate connected to the first scan line S1, a drain connected to the data signal input terminal Vdata, and a source connected to the third node N3; the third switch transistor T3 has a gate connected to the second scan line S2, a source connected to the first node N1, and a drain connected to the source of the first switch transistor T1; the fourth switch transistor T4 has a gate connected to the second scan line S2, a drain connected to the OLED, and a source connected to the third node N3; the fifth switch transistor T5 has a gate connected to the first scan line S1, a source connected to the drain of the third switch transistor T3, and a drain connected to the second node N2; the sixth switch transistor T6 has a gate connected to the third scan line S3, a source connected to one terminal of the storage capacitor C and the second node C2, and a drain connected to the first power supply ELVd; the other terminal of the storage capacitor C is connected to the signal input terminal ELVss; the OLED is connected to the third power supply ELVdd.

For example, the first switch transistor T1, the second switch transistor T2, the third switch transistor T3, the fourth switch transistor T4, the fifth switch transistor T5 and the sixth switch transistor T6 are N type thin film transistors.

The operating process of the pixel circuit will be described in detail below in conjunction with the pixel circuit shown in FIG. 4 and the timing diagram shown in FIG. 5. This operating process is divided into three phases: an initialization phase, a data writing and charging phase and an operation phase.

Figure 5:
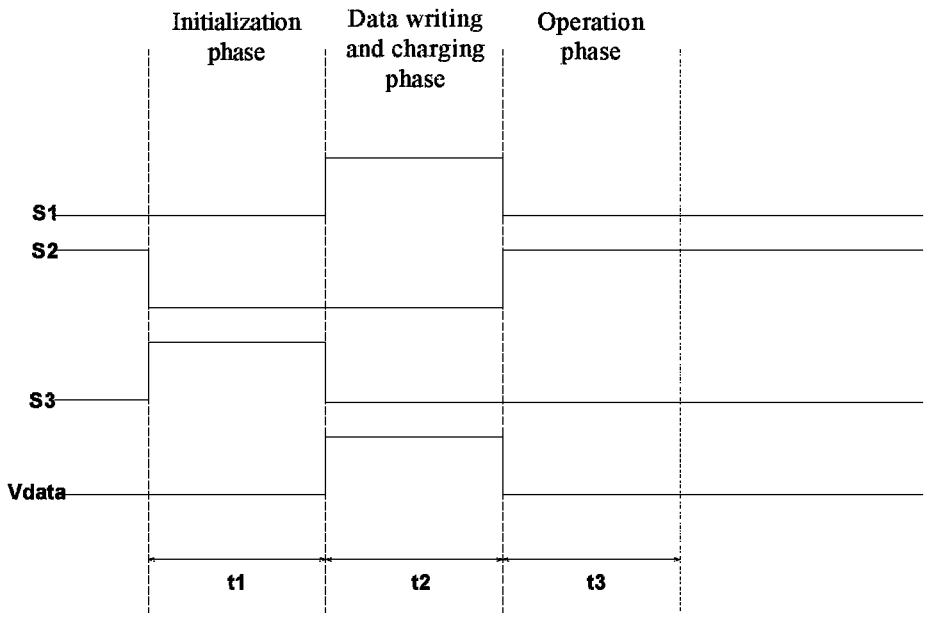
FIG. 5 is a timing diagram of the pixel circuit in FIG. 4.

The first phase is the initialization phase t1, in this phase, as shown in FIG. 5, a first scan signal outputted by the first scan line S1, a second scan signal outputted by the second scan line S2 and a voltage of the data signal input terminal Vdata each are at a low level, and a third scan signal outputted by the third scan line S3 is at a high level. The sixth switch transistor T6 is turned on under the control of the high-level third scan signal outputted by the third scan line S3. In this case, the first power supply ELVd outputs a high-level first voltage to the gate of the first switch transistor T1 so that the first switch transistor T1 is in on state. Furthermore, the second switch transistor T2, the third switch transistor T3, the fourth switch transistor T4 and the fifth switch transistor T5 are all turn off under the control of the low-level first scan signal outputted by the first scan line S1 and the low-level second scan signal outputted by the second scan line S2, and thus the operation unit, i.e., the OLED, is in non-operation state.

The second phase is the data writing and charging phase t2, in this phase, as shown in FIG. 5, the first scan signal outputted by the first scan line S1 and the voltage of the data signal input terminal Vdata each are at a high level, and the second scan signal outputted by the second scan line S2 and the third scan signal outputted by the third scan line S3 each are at a low level. The second switch transistor T2 and the fifth switch transistor T5 are turned on under the control of the high-level first scan signal outputted by the first scan line S1, and the third switch transistor T3, the fourth switch transistor T4 and the sixth switch transistor T6 are turned off under the effect of the low-level second scan signal outputted by the second scan line S2 and the low-level third scan signal outputted by the third scan line S3. In this case, the voltage of the data signal input terminal Vdata will be inputted to the drain of the first switch transistor T1 via the second switch transistor T2. It can be known from phase t1 that, the first switch transistor T1 is turned on under the effect of the first voltage. Since the fifth switch transistor T5 is on, the gate and the source of the first switch transistor T1 are connected, and a circuit similar to a diode is formed. Since the first voltage first inputted to the first switch transistor T1 is at a high level, the diode will be cut off when gate voltage of the first switch transistor T1 reaches Vdata+Vth, that is, the voltage at the second node N2 is $V_{N2}$=Vdata+Vth, where Vth is the threshold voltage of the first switch transistor T1; in this case, the voltage across the two terminals of the storage capacitor C is a voltage between the second node N2 and the first node N1, i.e., $V_{N2N1}$=Vdata+Vth-ELVss, where, ELVss is the voltage of the signal input terminal. Therefore, as a result of charging for the purpose of voltage compensation, the threshold voltage of the first switch transistor T1 is inputted into the voltage difference $V_{N2N1}$ across the two terminals of the storage capacitor C; at this time, since the fourth switch transistor T4 is turned off, the operation unit 11 is in non-operation state.

The third phase is the operation phase t3, in this phase, as shown in FIG. 5, the first scan signal outputted by the first scan line S1, the third scan signal outputted by the third scan line S3 and the voltage of the data signal input terminal Vdata each are at a low level, and the second scan signal outputted by the second scan line S2 is at a high level. The third switch transistor T3 and the fourth switch transistor T4 are turned on under the control of the high-level second scan signal outputted by the second scan line S2, and the second switch transistor T2, the fifth switch transistor T5 and the sixth switch transistor T6 are all turned off under the control of the low-level first scan signal outputted by the first scan line S1 and the low-level third scan signal outputted by the third scan line S3. At this time, since the first switch transistor T1, the third switch transistor T3 and the fourth switch transistor T4 remain on, the voltage across the storage capacitor C may be discharged to the operation unit 11 via the first switch transistor T1, the third switch transistor T3 and the fourth switch transistor T4, to allow the operation unit 11 to operate.

In this case, a current flowing through the first switch transistor T1 may be expressed by the following formula:

$$I=K(Vgs-Vth)^2 \quad (1)$$

where, K=½*μ*Cox*W/L, a constant related to the transistor.

Gate-source voltage of the first switch transistor T1 remains at its value at the end of the previous phase t2, i.e., $$Vgs=V_{N2N1}=Vdata+Vth-ELVss \quad (2).$$

In addition, since a value obtained by subtracting the threshold voltage Vth from the gate-source voltage Vgs of the first switch transistor T1 is smaller than or equal to drain-source voltage Vds of the first switch transistor T1, i.e., Vgs−Vth≤Vds, the first switch transistor T1 is in saturated on state.

By substituting formula (2) into formula (1), turn-on current of the first switch transistor T1 may be obtained:

$$I=K(Vgs-Vth)^2=K(Vdata+Vth-ELVss-Vth)^2=K(Vdata-ELVss)^2. \quad (3)$$

It can be seen from formula (3) that the value of the current flowing through the first switch transistor T1 is irrelevant to its threshold voltage, that is, even if the threshold voltage of the first switch transistor T1 drifts after long-term use, the current flowing through the first switch transistor T1 will not be affected, which ensures operation quality of the operation unit 11. Accordingly, since the operation quality of the operation unit 11 in a single pixel circuit is ensured, non-uniformity of the threshold voltage of the first switch transistor T1 can be compensated effectively by using the present pixel circuit, which improves image uniformity of a display device without using an external compensation circuit to compensate for the threshold voltage, and thus reduces research and manufacture costs. Furthermore, this pixel circuit has simple control timing and is easy to implement.

For example, sizes of the fifth switch transistor T5 and the sixth switch transistor T6 are the same.

The reason for such arrangement is as follows: if electric leakage occurs in the fifth switch transistor T5, the gate voltage of the first switch transistor T1 will be changed in subsequent continuous operating phases, and thus, in order to maintain a voltage value of the inputted voltage of the data signal input terminal Vdata, leakage current may be compensated by the first voltage outputted by the first power supply ELVd. The specific method is as follows: in the process of preparing the fifth switch transistor T5 and the sixth switch transistor T6, the fifth switch transistor T5 and the sixth switch transistor T6 are designed to have a same size, and in the meanwhile, in the subsequent operation phase of the operation unit 11, a voltage difference of the first power supply ELVd relative to the second node N2 is designed to be equal to a voltage difference of the second node N2 relative to the fourth node N4. For this purpose, the voltage value of the first power supply ELVd needs to be designed as: ELVd=2(Vdata+Vth)−ELVss. In this way, a gate leakage current of the first switch transistor T1 generated by the fifth switch transistor T5 can be compensated by leakage current of the sixth switch transistor T6, thus, overall luminous uniformity and display quality of the AMOLED display panel are improved, and image uniformity of an organic light emitting display is enhanced.

Apparently, the operation unit 11 in the embodiment is not limited to the OLED, and other device may also be applicable to the embodiment, which is not elaborated here.

The pixel circuit in this embodiment includes the operation unit 11, the storage module 12, the driving module 13, the compensation module 14 and the control module 15, and in this pixel circuit, drift of the threshold voltage of the driving module 13, which occurs as the display time of the panel increases, can be compensated, and thus non-uniformity of the threshold voltage of the driving module 13 can be compensated effectively, so that the luminance of AMOLED display panel is irrelevant to the threshold voltage of the driving module 13; in the meanwhile, by compensating for the change in the gate voltage of the driving module 13 (the first switch transistor T1) caused by leakage current of the switch transistor (the fifth switch transistor T5), overall luminous uniformity and display quality of the AMOLED display panel are improved, and image uniformity of an organic light emitting display is enhanced.

Embodiment 3

This embodiment provides a driving method of a pixel circuit, and as shown in FIGS. 3 and 4, the pixel circuit includes: an operation unit 11, a storage module 12, a driving module 13, a compensation module 14 and a control module 15. The driving module 13 is connected to the control module 15, the compensation module 14 and the storage module 12. The control module 15 is connected to the operation unit 11, the compensation module 14, the driving module 13, the storage module 12 and a signal input terminal ELVss. The compensation module 14 is connected to the control module 15, the driving module 13, the storage module 12 and a first power supply ELVd. The storage module 12 is connected to the compensation module 14, the driving module 13, the control module 15 and the signal input terminal ELVss. The operation unit 11 is connected to the control module 15 and a third power supply ELVdd. This driving method includes: in an initialization phase, initializing the compensation module 14 and the driving module 13 under the control of the first power supply; in a data writing and charging phase, charging, by the data signal input terminal, the storage module 12 via the compensation module 14 and the driving module 13, such that a threshold voltage corresponding to the driving module 13 is inputted into a voltage difference across the two terminals of the storage module 12; and in an operation phase, switching on the control module 15, and discharging the storage module 12 to the operation unit 11 via the driving module 13 so as to cause the operation unit 11 to operate and compensate for the influence of drift of the threshold voltage corresponding to the driving module 13 on performance of the operation unit 11.

For example, the storage module 12 includes a storage capacitor; the driving module 13 includes a first switch transistor T1, and the compensation module 14 includes a sixth switch transistor T6 and a third scan line S3; the step of initializing the compensation module 14 and the driving module 13 under the control of the first power supply ELVd includes: turning on the sixth switch transistor T3 under the control of a third scan signal outputted by the third scan line S3; and outputting, by the first power supply ELVd, a first voltage to the first switch transistor T1 via the turned-on sixth switch transistor T6, so as to turn on the first switch transistor T1.

For example, the compensation module 14 includes a first scan line S1, a second switch transistor T2 and a fifth switch transistor T5, and the driving module 13 includes the first switch transistor T1; the step of charging, by the data signal input terminal, the storage module 12 via the compensation module 14 and the driving module 13 such that a threshold voltage corresponding to the driving module 13 is inputted into a voltage difference across the two terminals of the storage module 12 includes: turning on the second switch transistor T2 and the fifth switch transistor T5 under the control of a first scan signal outputted by the first scan line S1; outputting, by the data signal input terminal, a voltage of the data signal input terminal Vdata to the first switch transistor T1 via the turned-on second switch transistor T2 and fifth switch transistor T5; and charging, by the first switch transistor T1, the storage capacitor C such that a threshold voltage of the first switch transistor T1 is inputted into the voltage difference across the two terminals of the storage capacitor C.

For example, the control module 15 includes a second scan line S2, a third switch transistor T3 and a fourth switch transistor T4, and the driving module 13 includes the first switch transistor T1; the steps of turning on the control module 15 under the control of a second scan signal outputted by the second scan line S2 and discharging the storage module 12 to the operation unit 11 via the driving module 13 include: turning on the third switch transistor T3 and the fourth switch transistor T4 under the control of a second scan signal outputted by the second scan line S2; and discharging the storage capacitor C to the operation unit 11 via the turned-on first switch transistor T1, third switch transistor T3 and fourth switch transistor T4, so as to allow the operation unit 11 to operate.

For example, voltage of the first power supply is ELVd=2(Vdata+Vth)−ELVss, where, Vdata is a voltage of the data signal input terminal, Vth is the threshold voltage of the first switch transistor T1, and ELVss is a voltage of the signal input terminal.

Specific implementation of the driving method of the pixel circuit provided by this embodiment has the same operating principle as Embodiment 2, and is thus not repeated here.

The pixel circuit used in this embodiment includes the operation unit 11, the storage module 12, the driving module 13, the compensation module 14 and the control module 15, and by using the driving method in this embodiment to drive the pixel circuit, drift of the threshold voltage of the driving module 13, which occurs as the display time of the panel increases, can be compensated, and thus non-uniformity of the threshold voltage of the driving module 13 can be compensated effectively, so that the luminance of AMOLED display panel is irrelevant to the threshold voltage of the driving module 13; in the meanwhile, by compensating for the change in the gate voltage of the driving module 13 caused by leakage current of the switch transistor, overall luminous uniformity and display quality of the AMOLED display panel are improved, and image uniformity of an organic light emitting display is enhanced.

The driving method of the pixel circuit provided by this embodiment is simple and easy to implement, and thus has wider applicability.

Embodiment 4

This embodiment provides an array substrate including the pixel circuit in Embodiment 2.

In the array substrate of the this embodiment including the pixel circuit in Embodiment 2, drift of the threshold voltage of the driving module 13, which occurs as the display time of the panel increases, can be compensated, and thus non-uniformity of the threshold voltage of the driving module 13 can be compensated effectively, so that the luminance of AMOLED display panel is irrelevant to the threshold voltage of the driving module 13; in the meanwhile, by compensating for the change in the gate voltage of the driving module 13 caused by leakage current of the switch transistor, overall luminous uniformity and display quality of the AMOLED display panel are improved, so that image uniformity of an organic light emitting display is enhanced, and performance of the array substrate in this embodiment is more stable.

Embodiment 5

This embodiment provides a display device including an array substrate, and the array substrate is the array substrate described in Embodiment 4, and is thus not repeated here.

Needless to say, the display device in the present embodiment may include any product or component with a display function, such as an OLED panel, a mobile phone, a tablet computer, a television, a monitor, a notebook computer, a digital photo frame, a navigator or the like.

As the display device includes the above array substrate, the display device in this embodiment has significantly improved image uniformity.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A pixel circuit, comprising: an operation unit, a storage module, a driving module, a compensation module and a control module, wherein, the driving module is connected to the control module, the compensation module and the storage module, the control module is also connected to the operation unit, the compensation module, the storage module and a signal input terminal, the compensation module is also connected to the storage module, a first power supply and a data signal input terminal, the storage module is also connected to the signal input terminal, and the operation unit is also connected to a third power supply;

in an initialization phase, the compensation module and the driving module are initialized under the control of the first power supply;

in a data writing and charging phase, the data signal input terminal charges the storage module via the compensation module and the driving module, such that a threshold voltage corresponding to the driving module is inputted into a voltage difference across two terminals of the storage module; and in an operation phase, the control module is switched on, and the storage module discharges to the operation unit via the driving module so as to allow the operation unit to operate and compensate for influence of drift of the threshold voltage corresponding to the driving module on performance of the operation unit, wherein, the compensation module comprises a second switch transistor, a fifth switch transistor, a sixth switch transistor, a first scan line and a third scan line, the second switch transistor has a gate connected to the first scan line, a drain connected to the data signal input terminal, and a source connected to the driving module and the control module via a third node;

the fifth switch transistor has a gate connected to the first scan line, a source connected to the driving module and the control module via a fourth node, and a drain connected to the driving module and the storage module via a second node; and the sixth switch transistor has a gate connected to the third scan line, a source connected to the storage module and the driving module via the second node, and a drain connected to the first power supply, sizes of the fifth switch transistor and the sixth switch transistor are the same, a voltage of the first power supply is ELVd=2(Vdata+Vth)−ELVss, where Vdata is a voltage of the data signal input terminal, Vth is the threshold voltage corresponding to the driving module, and ELVss is a voltage of the signal input terminal.

2. The pixel circuit according to claim 1, wherein, the storage module comprises a storage capacitor, one terminal of the storage capacitor is connected to the signal input terminal and the control module via a first node, and the other terminal of the storage capacitor is connected to the driving module and the compensation module via a second node.

3. The pixel circuit according to claim 1, wherein, the driving module comprises a first switch transistor; and the first switch transistor has a gate connected to the compensation module and the storage module via a second node, a source connected to the control module and the compensation module via a fourth node, and a drain connected to the compensation module and the control module via a third node.

4. The pixel circuit according to claim 1, wherein, the control module comprises a third switch transistor, a fourth switch transistor and a second scan line;

the third switch transistor has a gate connected to the second scan line, a source connected to the storage module and the signal input terminal via a first node, and a drain connected to the driving module and the compensation module via a fourth node; and the fourth switch transistor has a gate connected to the second scan line, a drain connected to the operation unit, and a source connected to the compensation module and the driving module via a third node.

5. The pixel circuit according to claim 1, wherein, the operation unit comprises an OLED.

6. An array substrate, comprising the pixel circuit according to claim 1.

7. The array substrate according to claim 6, wherein, the storage module comprises a storage capacitor, one terminal of the storage capacitor is connected to the signal input terminal and the control module via a first node, and the other terminal of the storage capacitor is connected to the driving module and the compensation module via a second node.

8. The array substrate according to claim 6, wherein, the driving module comprises a first switch transistor; and the first switch transistor has a gate connected to the compensation module and the storage module via a second node, a source connected to the control module and the compensation module via a fourth node, and a drain connected to the compensation module and the control module via a third node.

9. A display device, comprising the array substrate according to claim 6.

10. A driving method of a pixel circuit, wherein, the pixel circuit comprises: an operation unit, a storage module, a driving module, a compensation module and a control module, the driving module is connected to the control module, the compensation module and the storage module, the control module is also connected to the operation unit, the compensation module, the storage module and a signal input terminal, the compensation module is also connected to the storage module, a first power supply and a data signal input terminal, the storage module is also connected to the signal input terminal, and the operation unit is also connected to a third power supply;

the driving method comprises:

in an initialization phase, initializing the compensation module and the driving module under the control of the first power supply;

in a data writing and charging phase, charging, by the data signal input terminal, the storage module via the compensation module and the driving module, such that a threshold voltage corresponding to the driving module is inputted into a voltage difference across two terminals of the storage module; and in an operation phase, switching on the control module, and discharging the storage module to the operation unit via the driving module so as to allow the operation unit to operate and compensate for influence of drift of the threshold voltage corresponding to the driving module on performance of the operation unit, wherein, the driving module comprises a first switch transistor, and the compensation module comprises a sixth switch transistor and a third scan line; and the step of initializing the compensation module and the driving module under the control of the first power supply comprises:

turning on the sixth switch transistor under the control of a third scan signal outputted by the third scan line; and outputting, by the first power supply, a voltage of the first power supply to the first switch transistor via the turned-on sixth switch transistor, so as to turn on the first switch transistor, the voltage of the first power supply is $ELVd=2(Vdata+Vth)-ELVss$, where Vdata is a voltage of the data signal input terminal, Vth is a threshold voltage of the first switch transistor, and ELVss is a voltage of the signal input terminal.

11. The driving method of a pixel circuit according to claim 10, wherein, the compensation module comprises a first scan line, a second switch transistor and a fifth switch transistor, and the driving module comprises a first switch transistor; and the step of charging, by the data signal input terminal, the storage module via the compensation module and the driving module such that a threshold voltage corresponding to the driving module is inputted into a voltage difference across two terminals of the storage module comprises:

turning on the second switch transistor and the fifth switch transistor under the control of a first scan signal outputted by the first scan line;

outputting, by the data signal input terminal, a voltage of the data signal input terminal to the first switch transistor via the turned-on second switch transistor and fifth switch transistor; and charging, by the first switch transistor, the storage capacitor such that a threshold voltage of the first switch transistor is inputted into the voltage difference across the two terminals of the storage module.

12. The driving method of a pixel circuit according to claim 10, wherein, the control module comprises a second scan line, a third switch transistor and a fourth switch transistor, and the driving module comprises a first switch transistor; and the step of switching on the control module and discharging the storage module to the operation unit via the driving module comprises:

turning on the third switch transistor and the fourth switch transistor under the control of a second scan signal outputted by the second scan line; and discharging the storage capacitor to the operation unit via the turned-on first switch transistor, third switch transistor and fourth switch transistor, so as to allow the operation unit to operate.

* * * * *